US008898829B1

(12) United States Patent
Bartlett et al.

(10) Patent No.: US 8,898,829 B1
(45) Date of Patent: Dec. 2, 2014

(54) MODULAR BED FRAME END BOARD

(71) Applicant: Case Systems, Inc., Midland, MI (US)

(72) Inventors: Cody D. Bartlett, Wheeler, MI (US); Michael J. McKeon, Jacksonville, FL (US)

(73) Assignee: Case Systems, Inc., Midland, MI (US)

( * ) Notice: Subject to any disclaimer, the term of this patent is extended or adjusted under 35 U.S.C. 154(b) by 0 days.

(21) Appl. No.: 14/315,835

(22) Filed: Jun. 26, 2014

(51) Int. Cl.
*A47C 19/02* (2006.01)

(52) U.S. Cl.
USPC ..... 5/53.1; 5/132

(58) Field of Classification Search
USPC ..... 5/53.1, 132, 159.1, 160, 178, 93.2
See application file for complete search history.

(56) References Cited

U.S. PATENT DOCUMENTS 5,038,427 A * 8/1991 Golden ..... 5/93.2
6,948,198 B1 * 9/2005 Eldersveld ..... 5/132
7,159,253 B2 * 1/2007 Yang ..... 5/53.1

* cited by examiner

*Primary Examiner* — Fredrick Conley
(74) *Attorney, Agent, or Firm* — Butzel Long

(57) ABSTRACT

A bed frame end board that can be easily disassembled and reassembled to replace damaged components and reduce the cost and labor associated with refurbishment of dormitory beds including a vertically oriented rail configured to interlock with a bed frame side member, an outboard panel, and an inboard panel; and vertically spaced apart cross members having opposite ends fixed to the posts, wherein the outboard panels are releasably fixed to the rail by a fastening system having a slotted fastening clip on the rail and a stud on the outboard panel engaging a slot in the clip, and wherein the cross members are releasably attached to the posts with a threaded fastener and stabilized against rotational movement with respect to the post by dowels received in aligned bores extending into abutting surfaces of the panels and posts.

19 Claims, 3 Drawing Sheets

MODULAR BED FRAME END BOARD

CROSS-REFERENCE TO RELATED APPLICATIONS

Not applicable.

FIELD OF THE DISCLOSURE

This disclosure relates to bed frames for dormitories, barracks, and other non-hospital institutional bedding, and more particularly to bed frame end boards adapted to interlock with bed frame side members to define a bed frame that can be easily and inexpensively refurbished.

BACKGROUND OF THE DISCLOSURE

Institutional bedding, such as in college dormitories, can sometimes be subjected to damage during the course of normal use, such as with scratches, gouges, dents, or stains. This presents a problem for colleges and dormitory management, as it has been determined that the condition of dormitory furniture can be an important factor in the decision process of perspective college students. Accordingly, there is a perceived need that dormitory furniture, including beds, should have a new or gently used appearance. This problem has been solved by refinishing lightly damaged bed components and replacing heavily damaged bed components, such as end boards (i.e., the headboard or footboard) or side boards. Either of these options is relatively expensive. Refinishing usually involves tagging damaged components, shipping the damaged components to a refinishing facility, sanding and refinishing the components, shipping the refinished components back to the dormitory rooms and reassembling the beds. In addition to being expensive, refinishing is also relatively time consuming due to all of the planning, transportation and logistics involved in the process. Replacement of end boards is usually even more expensive than refinishing, but may be necessary for certain types of damage, such as deep gouges.

There is a need for institutional beds that can be refurbished without refinishing and with very substantially reduced need for replacement of an entire end board.

SUMMARY OF THE DISCLOSURE

Disclosed is a modular bed frame end board comprised of aesthetic panels and cross members that are easily replaced individually as needed, eliminating the need to replace or refinish an entire bed frame end board. This allows the bed to be refurbished in the dormitory room, eliminating much of the costs and efforts associated with planning, transportation and logistics for refinishing damaged bed components.

The bed frame end board includes a pair of horizontally spaced apart posts, and a plurality of vertically spaced apart horizontal cross members connected with the posts. Each post includes a vertically oriented rail for interconnection with a bed frame side board, and an outboard panel that is releasably secured to the rail. Releasable securement of the outboard panel to the rail can be achieved using a fastening system including at least one slotted fastening clip fixed to either the rail or the outboard panel, and a securing stud affixed to the other of the rail and outboard panel of each post. Each stud engages a corresponding slotted fastening clip to releasably secure the outboard panel to the rail.

In certain aspects of this disclosure, the cross members are releasably attached to the posts with a threaded fastener. One or more dowels extending into bores in the cross members and posts can be used to stabilize the cross members against rotation relative to the posts around the longitudinal axis of a single threaded fastener used to secure an end of the cross member to a post.

In certain aspects of this disclosure, an inboard panel extends vertically along the length of the rail and is retained between the rail and an end of each of the cross members by the threaded fastener.

In certain aspects of this disclosure, the rail is formed of steel, and may be epoxy powder-coated.

In order to provide aesthetically desirable components at a low cost, further reducing the expense associated with refurbishing the bed frame end board, the outboard panel, inboard panel, cross members, or any combination of these components can be comprised of a particle board, fibre board, wafer board or plywood core to which a decorative laminate (e.g., a wood veneer or laminate) is adhered.

A plastic cap can be press fit to a top end of each post. A plastic foot can be press fit to a bottom end of each post, which can act as a glide to facilitate movement of the bed.

DETAILED DESCRIPTION

Figure 1:
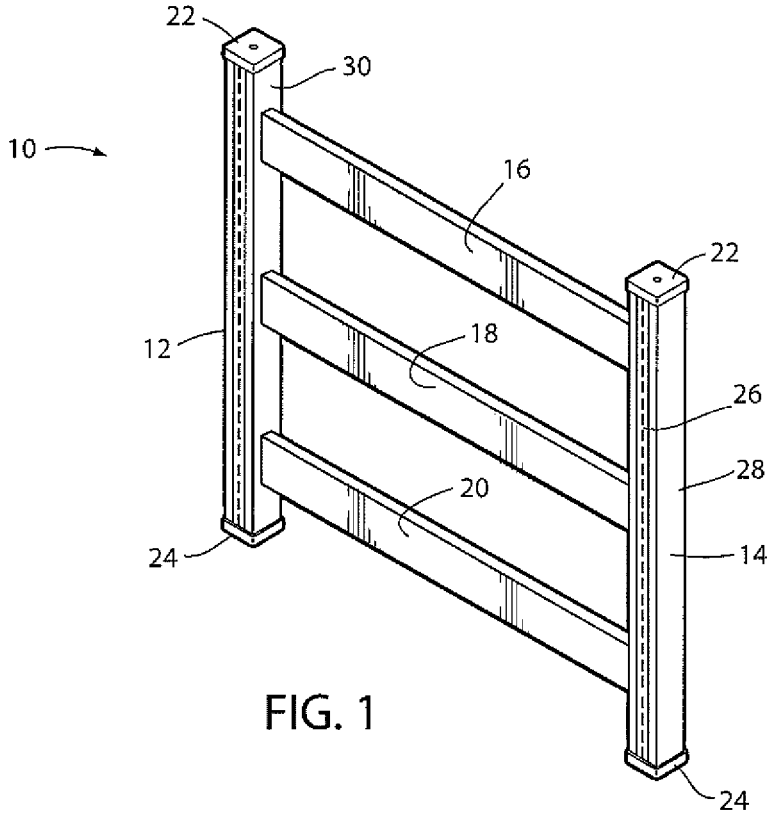
FIG. 1 is a perspective view of a bed frame end board as disclosed herein.
Figure 2:
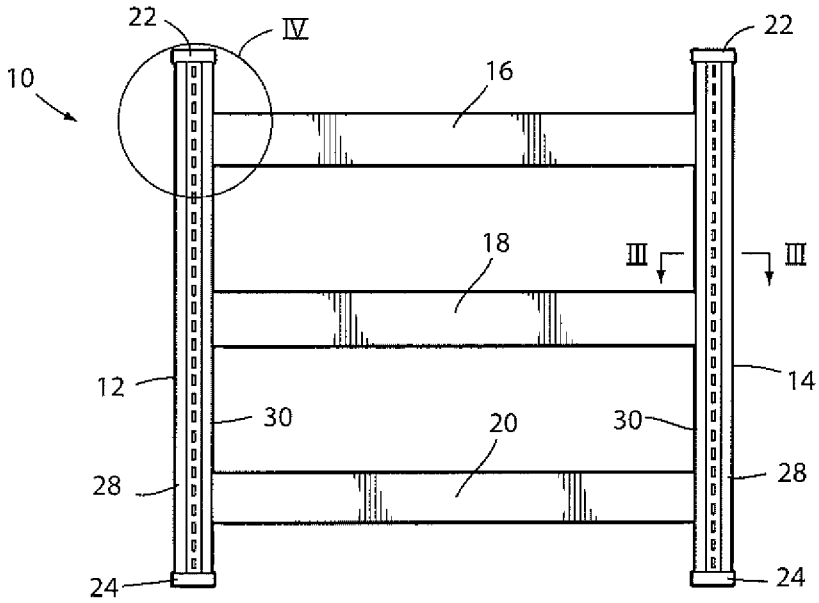
FIG. 2 is a front plan view of the bed frame end board shown in FIG. 1.
Figure 3:
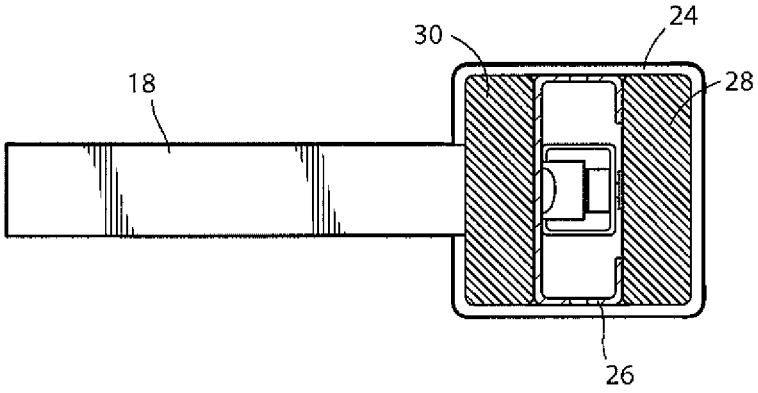
FIG. 3 is a cross-sectional view of a section of the bed frame end board as seen along lines C-C of FIG. 1.
Figure 4:
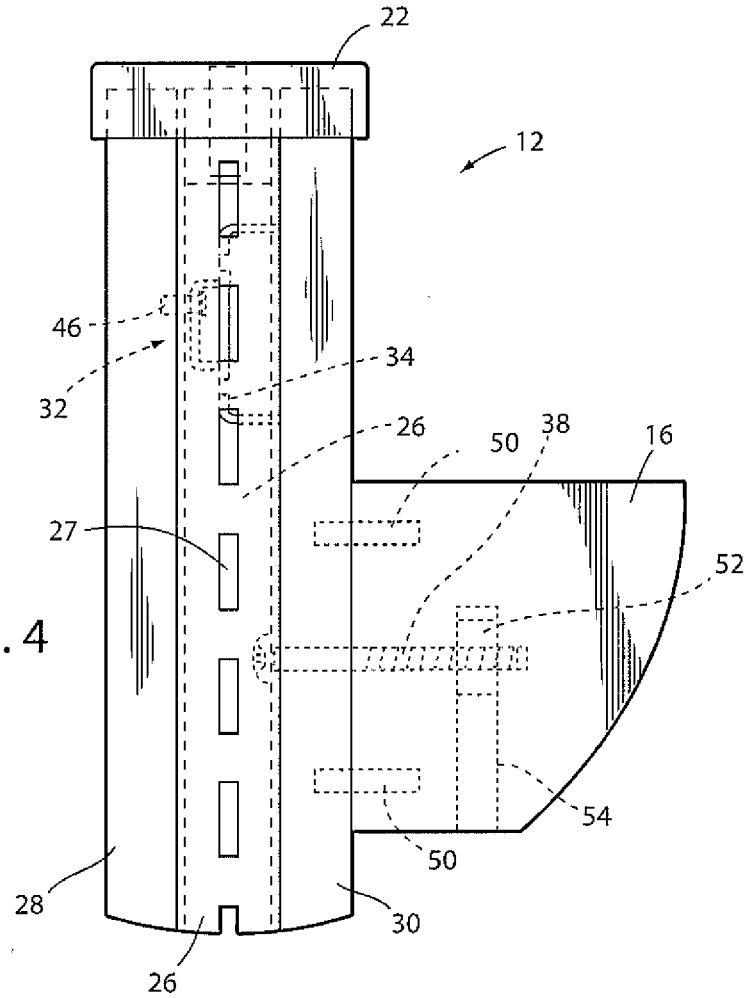
FIG. 4 is an enlarged fragmentary view of the area designated "IV" in FIG. 2.
Figure 5:
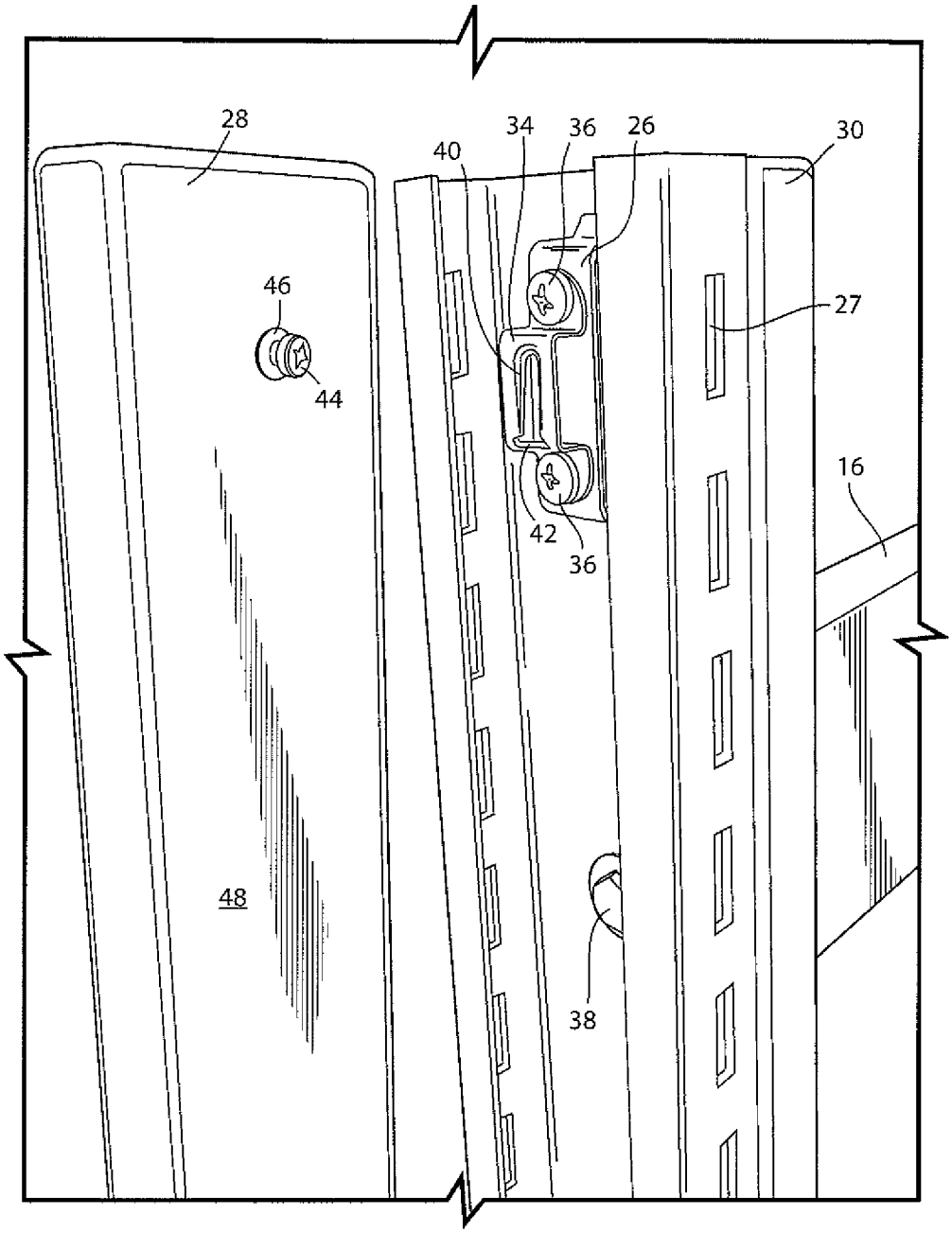
FIG. 5 is a partial perspective view of a bed frame end board post with an outboard panel removed to show a fastening system that facilitates replacement of components as needed to refurbish the bed frame end board.

Shown in FIG. 1 is a modular bed frame end board 10 in accordance with this disclosure. Bed frame end board 10 includes two spaced apart vertically arranged posts 12, 14 and a plurality of horizontally arranged cross members 16, 18, 20. A plastic cap 22 is press fit (or interference fit) to a top end of each of posts 12 and 14 to provide a finished appearance. Plastic feet 24 are press fit to a bottom end of each of posts 12 and 14 to protect the bottom end of posts 12 and 14, and to act as glides to facilitate movement of a bed comprising two end boards 10 connected together by side boards (not shown).

Each post 12, 14 includes a rail 26, an outboard panel 28, and an inboard panel 30. Rail 26 is configured to interlock with a bed frame side member (not shown), which typically has an L-shape profile, with the base of the L (or lip portion) being suitable for supporting slats, which in turn can support a mattress or box spring. In the illustrated embodiment, rail 26 includes a plurality of vertically elongate slots 27 for receiving a hook extending from an end of a bed frame side member.

An outboard panel 28 is releasably secured to the remaining portions of each post 12 and 14 by a fastening system 32 that employs a camming or wedging action to allow releasable attachment of outboard panels 28 to posts 12, 14 without tools. The fastening system 32 includes a slotted fastening clip 34 fixed to rail 26 and inboard panel 30 such as with threaded fasteners 36 that pass through fastener openings in slotted fastening clip 34, through aligned openings in rail 26. Slotted fastening clip 34 can be fastened to rail 26 only to eliminate a need to remove fasteners 36 to replace inboard panel 30 if it is damaged, with rail 26 being secured to inboard panel 30 and cross members 16, 18, 20 by threaded fasteners 38 (e.g., a bolt). Alternatively, slotted fastening clip 34 can be secured to both rail 26 and inboard panel 30 by fasteners 36, such as to provide more secure attachment of clips 34 to respective posts 12 and 14.

Slotted fastening clip 34 defines a slot 40 that has a bottom opening 42 that allows a head 44 of a stud 46 attached to an inboard side 48 of outboard panel 28 to enter the slot 40 with the underside of stud head 44 engaging an inclined or ramped surface that causes a camming or wedging action that draws outboard panel 28 into close engagement with rail 26 as stud 46 and panel 28 are moved or slid upwardly along the length of slot 40. An example of a suitable fastening clip that can be employed is described in U.S. Pat. No. 6,109,819. Such fastening systems are sold by Modular Systems, Inc. under the trademark "Mod-eez." Fastening system 32 can be non-locking, semi-locking or locking. Non-locking systems have the advantage of eliminating the need for tools or manipulation of the fastening system during removal of outboard panel 28 from post 12 or 14.

Outboard panel 28 can be secured to rail 26 using a single fastening system 32. However, a plurality of fastening systems can be employed for each post 12, 14.

Each of the cross members 16, 18 and 20 can be releasably secured to posts 12 and 14 by a threaded fastener 38. To facilitate easier assembly and disassembly, a single fastener 38 is used to secure each end of each cross member 16, 18, 20 to posts 12, 14. However, a plurality of fasteners can be used to secure each end of each cross member to a post. When a single fastener 38 is used to secure an end of a cross member 16, 18, 20 to a post 12, 14, one or more dowels 50 can be used to stabilize the cross members against rotation around the longitudinal axis of fastener 38. Dowels 50 can be received in aligned bores in the abutting surfaces of inboard panel 30 and each of the cross members 16, 18 and 20, and located vertically above or below fastener 38 or both above and below, as illustrated.

An internally threaded cross dowel 52 can be received in a bore 54 extending into a bottom surface of cross members 16, 18 and 20 to facilitate repeated disassembly and reassembly of the bed frame end board 10.

Rails 26, fastener clip 34, stud 40, fastener 38 and cross dowel 52 can be fabricated of a suitably strong material such as steel. Rail 26 can be painted or powder coated such as with an epoxy powder coating. Such coating can be selected to compliment or match aesthetic finishes or surface treatments on the cross members 16, 18, 20 and panels 28, 30.

Panels 28, 30 and cross members 16, 18 and 20 can be fabricated of any of a variety of different materials, such as wood, metal or plastic. However, to provide excellent aesthetics at a low cost, panels 28, 30 and cross members 16, 18, 20 can be fabricated from particle board, wafer board, fibre board or plywood provided with a decorative overlay or laminate on exposed surfaces, such as a wood veneer.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the claims attached herein.

What is claimed is:

1. A bed frame end board, comprising:

first and second horizontally spaced apart posts;

vertically spaced apart horizontal cross members, each cross member having a first end fixed to the first post and an opposite second end fixed to the second post;

wherein each of the posts includes a vertically oriented rail defining a plurality of slots for receiving a hook at an end of a bed frame side member; and wherein each of the posts includes an outboard panel and a fastening system including at least one slotted fastening clip fixed to one of the rail and outboard panel of each post, and a securing stud affixed to the other of the rail and outboard panel of each post, each stud engaging a corresponding slotted fastening clip to releasably secure the outboard panel to the rail.

2. The bed frame end board of claim 1, in which each end of each cross member is releasably attached to one of the posts with a threaded fastener.

3. The bed frame end board of claim 2, in which external threads of the threaded fastener engage internal threads of a cross dowel disposed in a bore defined in the cross member.

4. The bed frame end board of claim 3, in which each post further comprises an inboard panel.

5. The bed frame end board of claim 4, in which the cross member is stabilized against rotational movement with respect to the post around a longitudinal axis of the threaded fastener by at least one dowel received in adjacently aligned bores extending into an end of the cross member and an inwardly facing side of the inboard panel.

6. The bed frame end board of claim 5, in which the cross member is further stabilized against rotational movement with respect to the post around the axis of the threaded fastener by another dowel received in adjacently aligned bores extending into the end of the cross member and the inwardly facing side of the inboard panel, one of the dowels being vertically spaced above the threaded fastener and the other of the dowels being vertically spaced below the threaded fastener.

7. The bed frame end board of claim 1, in which the rail is formed of steel.

8. The bed frame end board of claim 7, in which the rail steel rail is epoxy powder-coated.

9. The bed frame end board of claim 1, in which the outboard panel is comprised of a particle board, fibre board, wafer board, or plywood core to which a decorative laminate is adhered.

10. The bed frame end board of claim 1, in which the cross members are comprised of a particle board, fibre board, wafer board, or plywood core to which a decorative laminate is adhered.

11. The bed frame end board of claim 1, further comprising a cap press fit to a top end of each post.

12. The bed frame end board of claim 1, further comprising a foot press fit to a bottom end of each post.

13. A bed frame end board, comprising:

first and second horizontally spaced apart posts, each post including a vertically oriented rail configured to interlock with a bed frame side member, an outboard decorative panel, and an inboard decorative panel;

vertically spaced apart horizontal cross members, each cross member having a first end fixed to the first post and a second end fixed to the second post;

wherein each post includes a fastening system having at least one slotted fastening clip fixed to one of the rail and outboard panel, and a securing stud fixed to the other of the rail and outboard panel, the stud engaging the slot in the clip to releasably join the outboard panel to the rail; and wherein each end of each cross member is releasably attached to one of the posts with a threaded fastener, and stabilized against rotational movement with respect to the post around a longitudinal axis of the threaded fastener by at least one dowel received in adjacently aligned bores extending into an end of the cross member and an inwardly facing side of the inboard panel.

14. The bed frame end board of claim 13, in which the rail is formed of steel.

15. The bed frame end board of claim 13, in which the rail steel rail is epoxy powder-coated.

16. The bed frame end board of claim 13, in which the outboard panel is comprised of a particle board, fibre board, wafer board, or plywood core to which a decorative laminate is adhered.

17. The bed frame end board of claim 13, in which the cross members are comprised of a particle board, fibre board, wafer board, or plywood core to which a decorative laminate is adhered.

18. The bed frame end board of claim 13, further comprising a cap press fit to a top end of each post.

19. The bed frame end board of claim 13, further comprising a foot press fit to a bottom end of each post.

* * * * *